US006352022B1

(12) United States Patent
Lau et al.

(10) Patent No.: US 6,352,022 B1
(45) Date of Patent: Mar. 5, 2002

(54) WEB CALENDERING METHOD AND APPARATUS

(75) Inventors: Ralph L. Lau, Port Edwards; Wayne A. Damrau, Wisconsin Rapids, both of WI (US)

(73) Assignee: Stora Enso North America, Wisconsin Rapids, WI (US)

( * ) Notice: Subject to any disclaimer, the term of this patent is extended or adjusted under 35 U.S.C. 154(b) by 0 days.

(21) Appl. No.: 09/373,470

(22) Filed: Aug. 12, 1999

(51) Int. Cl.[7] ..... D21G 1/00; B30B 3/04

(52) U.S. Cl. ..... 100/35; 100/153; 100/163 R; 162/205; 162/358.3

(58) Field of Search ..... 100/35, 161–167, 100/153, 75; 162/205, 358.3, 360.2, 360.3; 427/361

(56) References Cited

U.S. PATENT DOCUMENTS

| | | | | | |
|---|---|---|---|---|---|
| 2,300,994 | A | * | 11/1942 | Thiele et al. | 100/163 R |
| 2,611,717 | A | * | 9/1952 | Sooy et al. | |
| 3,254,593 | A | * | 6/1966 | Beachler | 100/162 R |
| 4,131,063 | A | * | 12/1978 | Joutsjoki | 100/162 R |
| 4,326,456 | A | * | 4/1982 | Kankaanpaa | 100/162 R |
| 4,332,191 | A | * | 6/1982 | Kankaanpaa | 100/162 R |
| 4,366,752 | A | * | 1/1983 | Koski | 100/162 R |
| 4,375,188 | A | * | 3/1983 | Leiviska | 100/162 R |
| 4,492,612 | A | * | 1/1985 | Matarainen | 100/162 R |
| 4,670,102 | A | | 6/1987 | Maurer et al. | |
| 4,704,191 | A | * | 11/1987 | Wedel | 100/153 |
| 4,915,026 | A | * | 4/1990 | Halme | 100/162 R |
| 5,251,551 | A | | 10/1993 | Abe et al. | |
| 5,400,707 | A | | 3/1995 | Neider et al. | |
| 5,483,873 | A | | 1/1996 | Koivukunnas et al. | |
| 5,524,532 | A | | 6/1996 | Koivukunnas et al. | |
| 5,784,955 | A | | 7/1998 | Conrad | |
| 5,836,242 | A | | 11/1998 | Aberg | |
| 5,916,419 | A | | 6/1999 | Nicholson et al. | |
| 6,022,448 | A | * | 2/2000 | Eriksson et al. | 162/205 |
| 6,106,902 | A | * | 8/2000 | Koskinen et al. | |

FOREIGN PATENT DOCUMENTS

| | | | |
|---|---|---|---|
| JP | 1-150667 | * | 6/1989 |
| JP | 1-183595 | * | 7/1989 |
| JP | 3-20111 | * | 1/1991 |
| JP | 3-130495 | * | 6/1991 |
| JP | 9-132893 | * | 5/1997 |
| JP | 9-228298 | | 9/1997 |

OTHER PUBLICATIONS

"Submillimeter Gloss Variations in Coated Paper", MacGregor and Johansson, TAPPI Journal, Jan. 1991, pp. 187–194.
"Calendering of coated paper and board in an extended soft nip", Wikstrom, Nyland and Rigdahl, Nordic Pulp and Paper Research Journal, vol. 12, No. 4, 1997, pp. 289–298.
"OptiDwell—The new Bulk preserving calendering method", Turtinen and Tani, Paper Technology, Mar. 1999, pp. 53–57.
"Blandin, Stora Mills Implement Steam Finishing for Better Gloss", Yeager, Pulp & Paper, Jul. 1998, pp. 117–120.
MTI Mottle Tester, Operation Manual, Tobias Associates, Inc., pp. 1 and 3.

* cited by examiner

*Primary Examiner*—Stephen F. Gerrity
(74) *Attorney, Agent, or Firm*—Greer, Burns & Crain, Ltd.

(57) ABSTRACT

Microgloss variations in and microgalvanizing of supercalendered webs of paper are significantly reduced without significant reduction in the super-calendered paper gloss by passing the supercalendered web through a heated soft extended nip calender.

17 Claims, 4 Drawing Sheets

WEB CALENDERING METHOD AND APPARATUS

FIELD OF THE INVENTION

The present invention relates to the calendering of paper webs to impart gloss to the paper, and more particularly, to a method and apparatus for minimizing microgloss variations and microgalvanizing in high gloss papers.

BACKGROUND

Gloss is imparted to paper webs, e.g., to coated printing papers, by the highly developed and well known art of calendering. Various types of calenders are employed in the paper industry, including hard nip calenders, soft nip calenders, supercalenders, and most recently, soft heated extended nip calenders of both belt and shoe types.

Supercalendering has generally been deemed to be the most effective method of obtaining extremely high surface gloss. Supercalendering has, however, been identified as contributing to variations in surface gloss which can result in a nonuniform, mottled appearance or orange peel effect that adversely affects the print quality of the paper. The resultant undesirable appearance is referred to as microgalvanizing and/or submillimeter and microgloss variations.

SUMMARY OF THE INVENTION

It is the object of the present invention to control microgloss variations and minimize microgalvanizing in high gloss paper, especially paper that has been supercalendered.

In accordance with the invention, it has been determined that microgalvanizing can be reduced and minimized by passing fully super-calendered webs through one or more calendering nips of a heated soft extended nip calender.

In particular, it has been determined pursuant to the invention that even a single pass of supercalendered paper through a very soft extended nip after the paper gloss has been fully developed will significantly reduce microgalvanizing while retaining the supercalendered paper gloss.

These and other features and advantages of the invention will become apparent to those reasonably skilled in the art from the following detailed description, as considered in connection with the accompanying drawings.

DETAILED DESCRIPTION

The following is a detailed description of certain embodiments of the invention presently deemed by the inventors to be the best mode of carrying out the invention.

Figure 1:
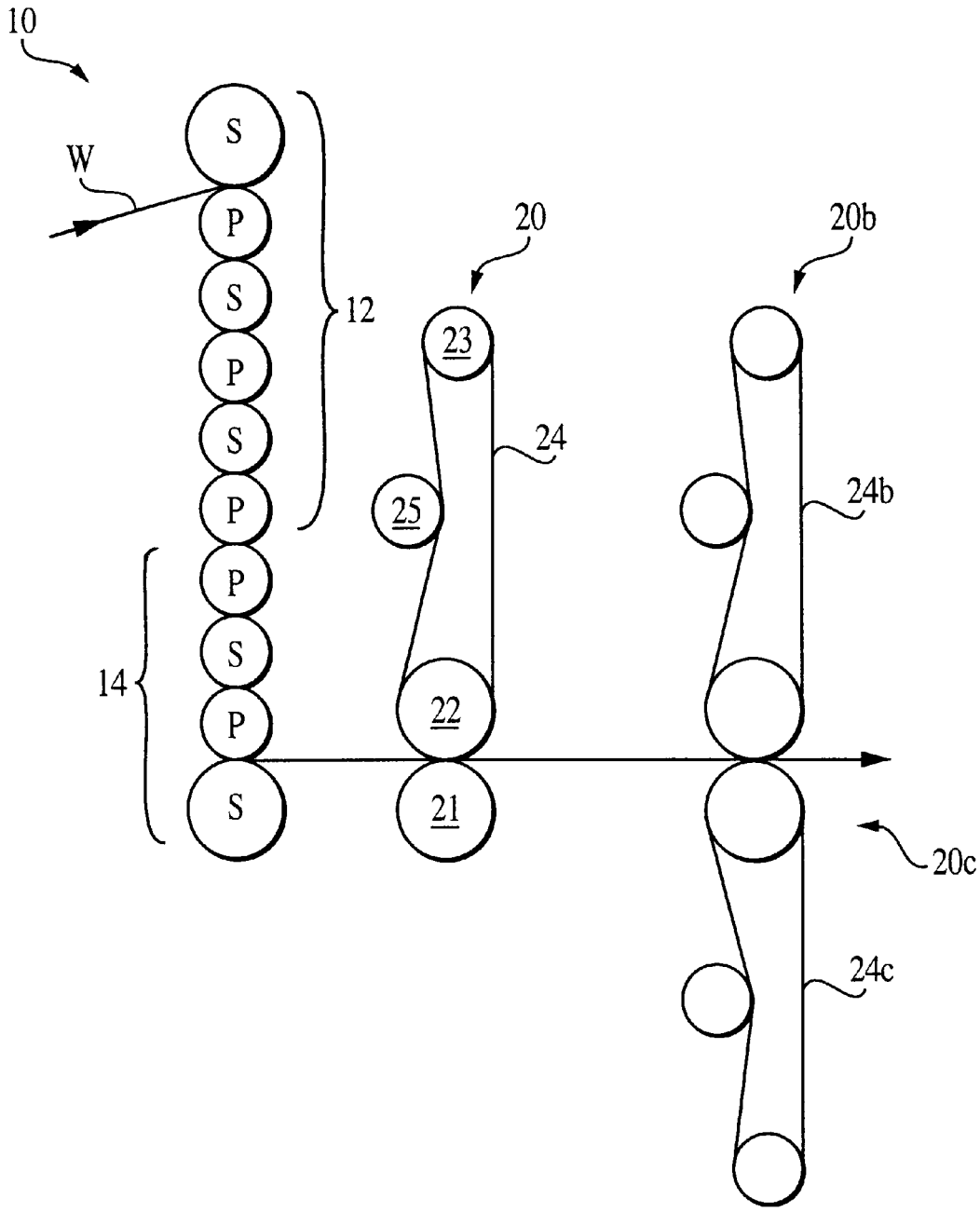
FIG. 1 is a schematic illustration of one embodiment of an apparatus comprising the essence of the invention and residing in the combination, in sequence, of a multiple roll supercalender stack and one or more extended nip calenders for calendering one or the other or both sides of a coated paper web.

Referring to FIG. 1, a supercalender 10 is typically comprised of a vertical stack of alternating nonresilient rolls S and resilient rolls P, with a web W of paper passing sequentially through the nips defined between adjacent pairs of rolls. The non resilient rolls S are typically smooth and highly polished steel rolls and the resilient rolls P currently used in the industry are commonly cotton or polymer filled rolls. The steel rolls are usually heated and a vertical load is applied to the stack so that the paper web W is pressed under heat and pressure as it passes through each of the roll nips S-P, P-S in the stack, and a gloss is imparted to the side of the paper in contact with the smooth surfaced non resilient roll S in each of the nips.

The stack of alternating rolls S and P may be arranged to supercalender just one side of the web W, or there may be a transition point in the stack so that one side of the web is first contacted by a plurality of the steel rolls 10 and then the other side of the web is thereafter contacted by another plurality of the steel rolls 10, so as to supercalender both sides of the web in a single pass of the web through the supercalender stack. For example, in the ten roll supercalender depicted in FIG. 1, a transition point is illustrated as occurring mid way in the stack by the provision of two contiguous resilient rolls P-P, so that the top six rolls in the stack comprise a five nip supercalender section 12 for supercalendering one side of the web and the bottom four rolls in the stack comprise a three nip supercalender section 14 for super-calendering the other side of the web.

The supercalender 10 is constructed and operated in an entirely conventional manner at usual and customary operating speeds, pressures and temperatures, all as is well known in the art. When so operated, the super-calender may impart to the web surface undesirable microgalvanizing or excessive submillimeter or microvariations in the surface gloss of the supered surface.

In accordance with the present invention, such microgalvanizing and/or microgloss variations are significantly reduced without significant change in the gloss of the super-calendered surface by further calendering the surface in one or more heated soft extended nip calenders.

As illustrated in FIG. 1, the present invention provides a heated soft extended nip calender 20 of the belt type in combination with and immediately downstream from the supercalender 10 to further calender one surface of the web and significantly reduce any microgalvanizing that may have occurred on that side of the web. Plural extended nip calenders may be utilized in sequence to further control microgloss variations and to provide further reductions in undesirable microgalvanizing, as is illustrated schematically at 20*b* in FIG. 1. Also, if the web is supercalendered on both sides, one or more additional heated soft extended nip calenders may be provided on the opposite side of the web W, as indicated at 20*c*, for further calendering of said opposite side of the web.

Typically, a heated soft extended nip calender 20 of the belt type is comprised of a heated backing roll 21, a pair of belt guide rolls 22 and 23, a soft and resilient endless belt 24 supported by the rolls 22 and 23 and forming a soft and arcuately extended nip with the backing roll 21, and a belt tensioning and cooling roll 25. As illustrated in FIG. 1, the extended nip calender 20 is constructed and operated in an entirely conventional manner at usual and customary operating speeds, pressures and temperatures, all as is well known in the art. When so operated, the extended nip calender significantly reduces microgalvanizing of the supercalendered paper while retaining the supercalendered paper gloss.

In two trials, fully supercalendered webs of coated publication papers were further calendered by a single pass through a heated soft extended nip belt calender operating at a temperature of 140° C. (284° F.) and a nip pressure of 350 kilonewtons per meter (kN/m), or approximately 1925 pounds per lineal inch (pli). The paper employed in the first trial was a 60 pound per ream web offset coated paper comprised of a 42 pound ground wood free base sheet coated 9 pounds per side. The paper employed in the second trial was a 150 pound per ream web offset coated paper comprised of a 116 pound ground wood free base sheet coated 17 pounds per side. As measured in Tobias units, microgalvanizing of the 60 pound coated paper was reduced from 988 to 865 and microgalvanizing of the 150 pound paper was reduced from 671 to 528; reductions of 12 ½% and 21 ½% respectively in just a single pass through the extended nip.

The further calendering in the above trials was performed on previously supercalendered paper entirely separately from the supercalendering operation. While this is an acceptable practice, it is preferable to perform the soft extended nip calendering coextensively with supercalendering as depicted in FIG. 1, thereby to avoid excessive handling, i.e., repeated reeling and unreeling of the web.

Figure 2:
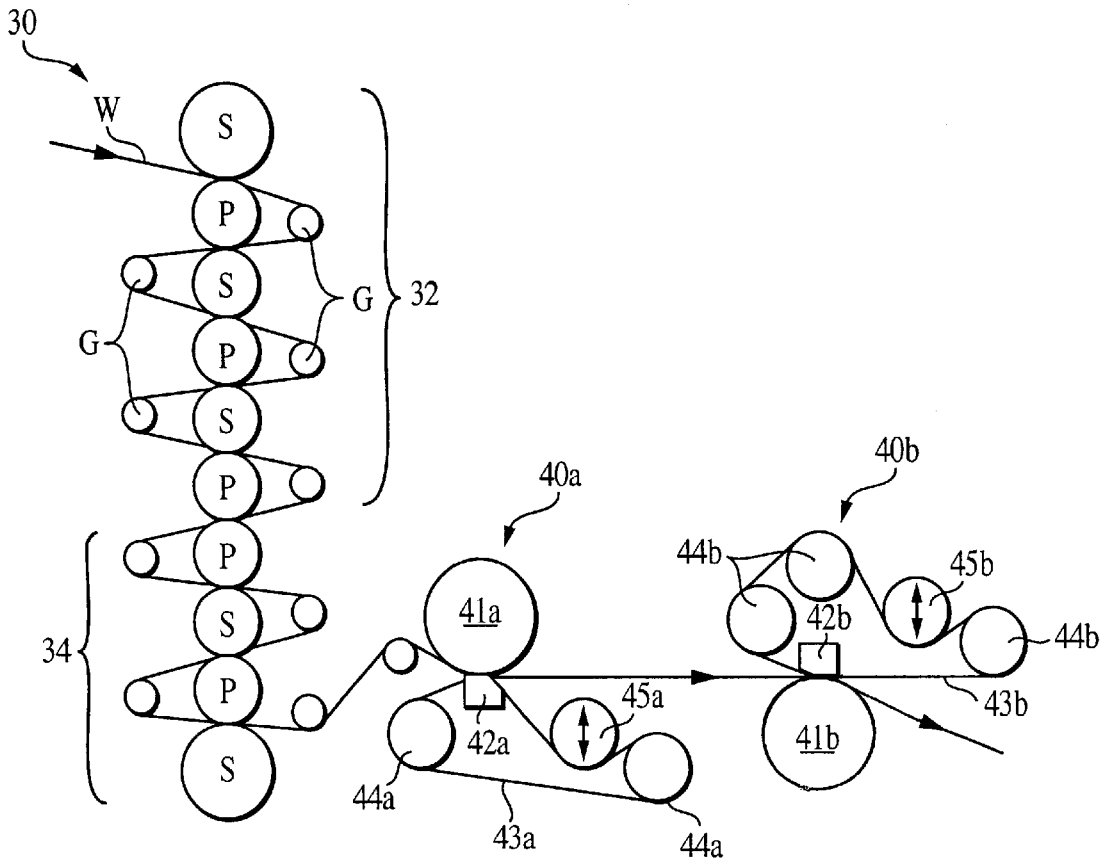
FIG. 2 is a schematic illustration of a second embodiment of the apparatus of the invention comprised of a ten roll supercalender constructed to supercalender both sides of a coated paper web and a pair of extended nip shoe calenders for calendering respective ones of the two supercalendered sides of the web.
Figure 3:
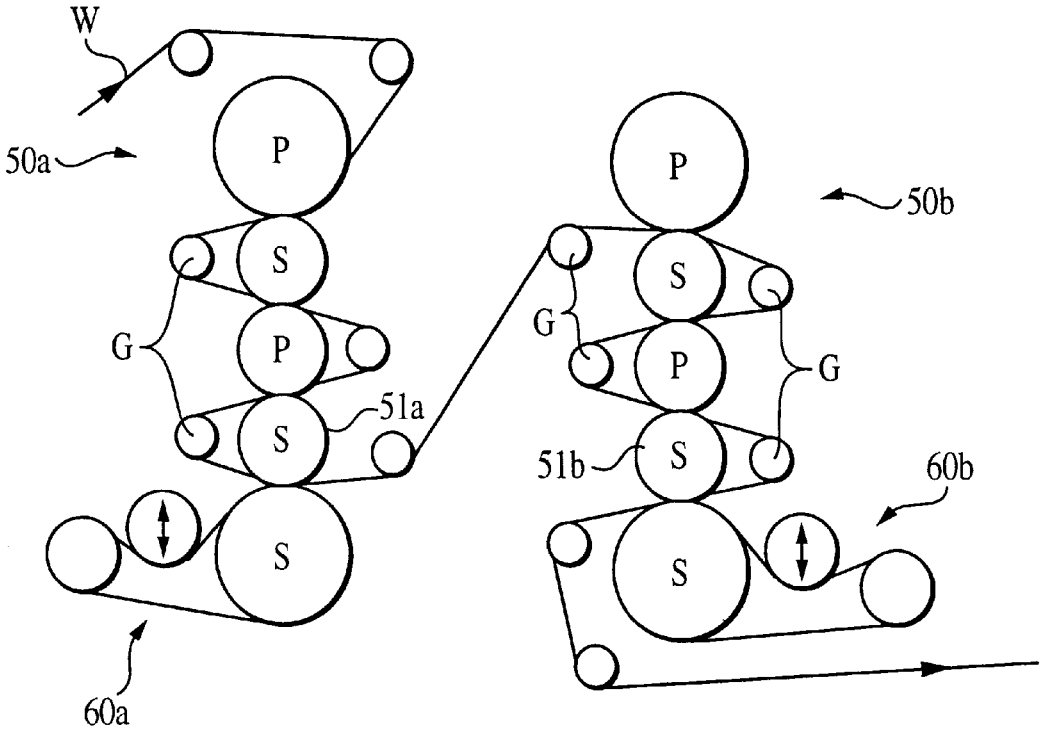
FIG. 3 is a schematic illustration of a third embodiment of the apparatus of the invention comprised of two five roll calender stacks each incorporating an extended nip belt calender.
Figure 4:
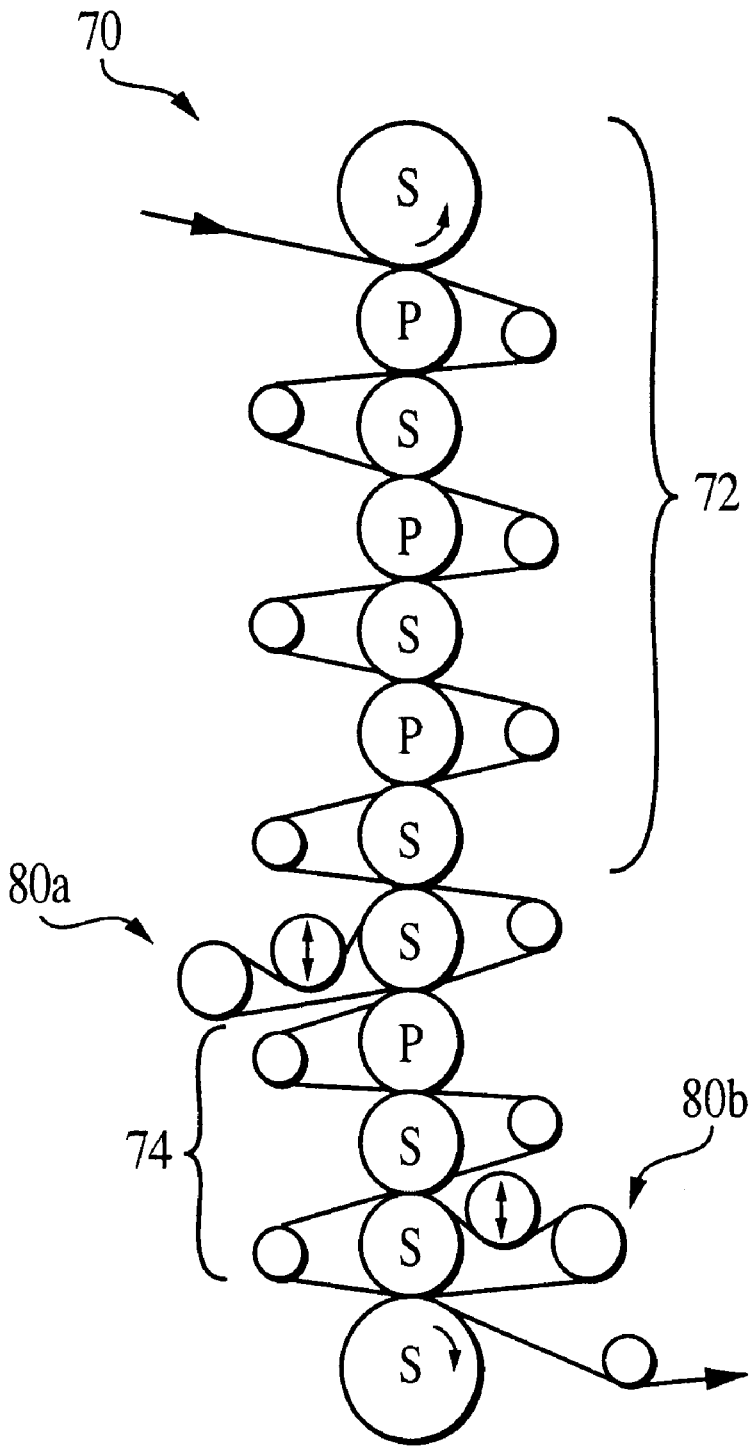
FIG. 4 is a schematic illustration of a fourth embodiment of the apparatus of the invention comprised of a twelve roll supercalender stack constructed to supercalender both sides of a paper web and including integral extended nip belt calenders for calendering respective ones of the supercalendered sides of the web.

FIGS. 2, 3 and 4 illustrate schematically additional modes of carrying out the invention.

In FIG. 2, a ten roll supercalender 30 is constructed to provide a first five nip supercalender section 32 for supercalendering one side of the paper web W and a second three nip supercalender section 34 for supercalendering the other side of the web. In the illustrated type of supercalender, guide rolls G are located intermediate each adjacent pair of supercalender rolls to guide the web into and out of each of the supercalender nips. Downstream from the supercalender 30 are a pair of extended soft nip calenders 40*a* and 40*b* for respectively further calendering the two sides of the web. The two extended nip calenders are illustrated as comprising a type of shoe calender, but they could just as well be belt calenders or other types of shoe calenders, or a combination of different types and different numbers of extended nip calenders. In the illustrated construction, each extended nip calender includes a backing roll 41*a*, 41*b*, a stationary shoe 42*a*, 42*b* forming a calender nip with the respective backing roll 41*a*, 41*b*, a soft and resilient belt, loop or cover 43*a*, 43*b* passing over the respective shoe and through the respective nip and, if needed, belt or loop supporting and tensioning rolls 44*a*, 45*a* and 44*b*, 45*b*. In any event, the extended nip calenders serve to minimize microgloss variations and any microgalvanizing that may have been imparted to the web surfaces during passage of the web through the supercalender.

The embodiment of the invention illustrated in FIG. 3 is comprised of a pair of supercalender stacks 50*a* and 50*b* and a pair of extended nip calenders 60*a* and 60*b* combined respectively with the supercalenders, specifically at the offgoing nip of each supercalender, to form a pair of multipurpose integrated calendering assemblies for calendering both sides of a web W in a single pass of the web through the two assemblies.

In both assemblies, the bottom calender roll 51*a*, 51*b* comprises the backing roll for the extended nip calenders 60*a*, 60*b*. Guide rolls G guide the web W through the calender nips and from one calender assembly to the other calender assembly in such manner as to calender one surface of the web in the left hand or "a" assembly and the other surface of the web in the right hand or "b" assembly. As in the other embodiments of the invention, the extended nip calenders 60*a*, 60*b* significantly reduce any microgalvanizing that may have occurred during passage of the web through the supercalenders 50*a*, 50*b*.

Referring to FIG. 4, a further embodiment of the apparatus of the invention is shown as being comprised of a supercalender stack 70 and a pair of extended nip calenders 80*a* and 80*b* integrated into the stack. The super-calender stack is comprised of twelve supercalender rolls with the upper seven rolls forming a six nip first supercalender section 72 and the remainder of the rolls forming a second supercalender section 74. Counting downward from the top of the stack, the seventh and eighth rolls are nonresilient or steel rolls and define therebetween a nip for the soft resilient belt, loop or cover of the extended nip calender 80*a*. The next succeeding nip, i.e., between the eighth and ninth rolls, is a combination nip comprising a non resilient eighth calender roll, a resilient ninth calender roll and the belt of the extended nip calender 80*a*. The next nip, between the ninth and tenth rolls, is a conventional super-calendering nip. The nips between the tenth and eleventh rolls and between the eleventh and twelfth rolls receive the belt of the extended nip calender 80*b* and may therefore comprise extended nip calenders, or one or the other or both may comprise combination nips, i.e., resilient roll, nonresilient roll and belt.

In all of its embodiments, the invention provides one or more extended nip calenders downstream from a supercalender effective to significantly reduce microgloss variations in and microgalvanizing of the supercalendered surfaces of paper webs while retaining supercalendered high paper gloss. The objects and advantages of the invention have therefore been shown to be attained in a convenient, practical, economical and facile manner.

While certain presently preferred embodiment of the invention have been herein illustrated and described, it is to be appreciated that various changes, rearrangements and modifications may be made therein without departing from the scope of the invention as defined by the appended claims.

What is claimed is:

1. A process of calendering a paper web to a high gloss with minimal microgloss variation comprising, in sequence, the steps of:

supercalendering a surface of the web, and further calendering the supercalendered surface in a soft extended nip.

2. A process as set forth in claim 1 wherein each of the two surfaces of the web is first supercalendered and then calendered in a soft extended nip.

3. A process as set forth in claim 1 wherein both surfaces of the web are first supercalendered and both surfaces are thereafter calendered in soft extended nips.

4. A process as set forth in claim 1 wherein the soft extended nip calendering is performed with a belt calender.

5. A process as set forth in claim 1 wherein the soft extended nip calendering is performed with a shoe calender.

6. Apparatus for calendering a paper web to a high gloss with minimal microgloss variation comprising, in combination and in sequence, a supercalender and a soft extended nip calender.

7. Apparatus as set forth in claim 6 for calendering both sides of a paper web comprising a first supercalender stack for supercalendering one side of the web, a first soft extended nip calender for calendering said supercalendered one side of the web, a second supercalender stack for super-calendering the other side of the web, and a second soft extended nip calendar for calendering said supercalendered other side of the web.

8. Apparatus as set forth in claim 7 wherein the first extended soft nip calender comprises the off going nip of the first supercalender and the second soft extended nip calender comprises the off going nip of the second super-calender.

9. Apparatus as set forth in claim 7 wherein the first and second extended nip calenders are spaced sequentially downstream from the first and second supercalender stacks.

10. Apparatus as set forth in claim 6 for calendering both sides of a paper web comprising a supercalender stack having a first section for super-calendering one side of the web and a second section for supercalendering the other side of the web, and a pair of soft extended nip calenders for respectively calendering the supercalendered one side of the web and the supercalendered other side of the web.

11. Apparatus as set forth in claim 10 wherein one of the soft extended nip calenders is interposed between the first and second sections of the super-calender stack.

12. Apparatus as set forth in claim 11 wherein the other soft extended nip calender comprises the off going nip of the second section of the super-calender stack.

13. Apparatus as set forth in claim 10 wherein the soft extended nip calenders are spaced sequentially downstream from the supercalender stack.

14. Apparatus as set forth in claim 6 wherein the soft extended nip calender comprises a belt calender.

15. Apparatus as set forth in claim 6 wherein the soft extended nip calender comprises a shoe calender.

16. Apparatus as set forth in claim 6 for calendering both sides of a paper web comprising one or more supercalender stacks for supercalendering both sides of the web and at least a pair of soft extended nip calenders for respectively calendering the two sides of the web.

17. Apparatus as set forth in claim 16 wherein at least one pair of soft extended nip calenders are juxtaposed to one another on opposite sides of the web and each extended nip calender serves as a backing member for the other.

* * * * *

UNITED STATES PATENT AND TRADEMARK OFFICE

CERTIFICATE OF CORRECTION

PATENT NO. : 6,352,022 B1
DATED : March 5, 2002
INVENTOR(S) : Ralph L. Lau et al.

It is certified that error appears in the above-identified patent and that said Letters Patent is hereby corrected as shown below:

Title page,
Item [75] Inventors should read: Ralph L. Lau, Port Edwards, Wisconsin; Wayne A. Damrau,Wisconsin Rapids, Wisconsin; Paul A. Jeltema, Wisconsin Rapids, Wisconsin; Dean F. Benjamin, Amherst, Wisconsin Signed and Sealed this Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,352,022 B1
DATED : March 5, 2002
INVENTOR(S) : Lau et al.

It is certified that error appears in the above-identified patent and that said Letters Patent is hereby corrected as shown below:

Title page,
Item [57], ABSTRACT,
Line 3, please delete "super-calendered" and insert -- supercalendered --

Column 1,
Line 34, please delete "super-calendered" and insert -- supercalendered -- therefor Column 2,
Line 40, please delete "super-calender" and insert -- supercalender -- therefor Column 4,
Line 27, please delete "super-calendering" and insert -- supercalendering -- therefor Column 5,
Line 6, please delete "super-calendering" and insert -- supercalendering -- therefor
Line 12, please delete "super-calender" and insert -- supercalender -- therefor
Line 18, please delete "super-calendering" and insert -- supercalendering -- therefor Column 6,
Line 3, please delete "super-calender" and insert -- supercalender -- therefor
Line 6, please delete "super-calender" and insert -- supercalender -- therefor Signed and Sealed this First Day of October, 2002

*Attest:*

*Attesting Officer*

JAMES E. ROGAN
*Director of the United States Patent and Trademark Office*